US012736288B2

(12) United States Patent
Capodagli et al.

(10) Patent No.: US 12,736,288 B2
(45) Date of Patent: Sep. 15, 2026

(54) HEAT EXCHANGER WITH TUBE BUNDLE COMPRISING AT LEAST TWO SECTIONS

(71) Applicant: VALMEX S.p.A., Lucrezia di Cartoceto (IT)

(72) Inventors: Severino Capodagli, Fano (IT); Simone Zurini, Fano (IT); Giacomo Betti, Fano (IT); Paolo Ferretti, Fano (IT)

(73) Assignee: VALMEX S.P.A., Lucrezia di Cartoceto (IT)

( * ) Notice: Subject to any disclaimer, the term of this patent is extended or adjusted under 35 U.S.C. 154(b) by 0 days.

(21) Appl. No.: 18/068,878

(22) Filed: Dec. 20, 2022

(65) Prior Publication Data

US 2023/0194179 A1 Jun. 22, 2023

(30) Foreign Application Priority Data

Dec. 22, 2021 (IT) ..... 102021000032207

(51) Int. Cl.

| | |
|---|---|
| ***F28D 7/02*** | (2006.01) |
| ***F24H 8/00*** | (2022.01) |
| ***F28D 7/00*** | (2006.01) |
| ***F28F 1/02*** | (2006.01) |

(Continued)

(52) U.S. Cl.

CPC ..... *F28D 7/0066* (2013.01); *F24H 8/00* (2013.01); *F28D 7/02* (2013.01); *F28F 1/02* (2013.01); *F28F 9/22* (2013.01); *F24H 1/0027* (2013.01); *F28F 2240/00* (2013.01)

(58) Field of Classification Search

CPC ..... F28D 1/0472; F28D 1/0473; F28D 7/04; F28D 9/0012; F28D 2001/0273; F28D 7/005; F28D 7/02; F28D 7/024; F28D 9/0132; F28D 9/0131; F28F 9/0204; F28F 9/0202; F28F 9/026; F28F 9/0265; F28F 9/028; F28F 2240/00; F24H 9/013

See application file for complete search history.

(56) References Cited

U.S. PATENT DOCUMENTS 5,845,609 A 12/1998 Corrigan
7,617,802 B2 * 11/2009 Le Mer ..... F24H 1/43 122/15.1

(Continued)

FOREIGN PATENT DOCUMENTS

EP 3141839 A1 3/2017
EP 3633286 A1 4/2020

(Continued)

OTHER PUBLICATIONS

Search Report and Written Opinion issued in corresponding Italian Application No. 102021000032207, with partial English translation, date of mailing Aug. 9, 2022 (9 pages).

*Primary Examiner* — Nelson J Nieves
(74) *Attorney, Agent, or Firm* — NIXON & VANDERHYE

(57) ABSTRACT

A heat exchanger with a tube bundle wound in a helical manner about a longitudinal axis. The tube bundle includes at least two tube sections which are placed beside each other in the direction of the longitudinal axis. The tube sections each include a helically wound tube with has an internal cross-section which is constant over the helical winding thereof.

9 Claims, 8 Drawing Sheets

(51) Int. Cl.
*F28F 9/22* (2006.01)
*F24H 1/00* (2022.01)

(56) References Cited

U.S. PATENT DOCUMENTS

| | | | | |
|---|---|---|---|---|
| 2003/0188856 | A1* | 10/2003 | Pays | F28F 9/0132 165/172 |
| 2006/0102106 | A1* | 5/2006 | Le Mer | F28D 7/024 122/32 |
| 2007/0209606 | A1* | 9/2007 | Hamada | F24H 1/523 122/18.1 |
| 2012/0312513 | A1* | 12/2012 | Le Mer | F24H 8/00 165/159 |
| 2017/0332513 | A1* | 11/2017 | Van Vliet | F28D 7/024 |
| 2019/0024942 | A1* | 1/2019 | Le Mer | F24H 1/40 |

FOREIGN PATENT DOCUMENTS

| | | | |
|---|---|---|---|
| FR | 2854229 | A1 | 10/2004 |
| WO | 94/16272 | A1 | 7/1994 |
| WO | 2016/001852 | A1 | 1/2016 |

* cited by examiner

HEAT EXCHANGER WITH TUBE BUNDLE COMPRISING AT LEAST TWO SECTIONS

CROSS-REFERENCE TO RELATED APPLICATION

This claims priority from Italian Application No. 102021000032207, filed Dec. 22, 2021, the disclosure of which is hereby incorporated by reference in its entirety.

FIELD OF THE INVENTION

The present invention relates to a heat exchanger for condensing boilers.

The invention has been developed with particular regard to a heat exchanger of the type comprising a tube bundle which is wound in a helical manner.

TECHNOLOGICAL BACKGROUND

There are known heat exchangers for condensing boilers comprising a tube bundle which is wound in a helical manner. The tube bundle of such heat exchangers comprises one or more tubes which are wound in a helical manner about a longitudinal axis so as to form a series of coils which are passed over by the combustion gases of a burner so as to heat a fluid, normally water, which flows inside the tube bundle. Examples of such heat exchangers are described in the documents WO 2016/001852 A1 and EP 3633286 A1 from the same Applicant.

In the heat exchangers of the above-indicated type, the fluid which flows in the tube bundle is advantageously also heated by the latent condensation heat of the combustion gases which substantially increases the thermal efficiency. Therefore, there has been a shift from heat exchangers with relatively low power, which are used for home, to powers which are increasingly high in order to also satisfy utilities of the professional and industrial types.

In order to obtain high thermal powers, it is necessary to increase the flow rate of the fluid to be heated and the thermal power of the burner. Therefore, it is necessary to construct heat exchangers which are relatively large with an extent of the tube bundle which is sufficient to ensure a complete and efficient heat exchange between the combustion gases and the fluid which flows in the tube bundle itself. On the other hand, the extension of the tube bundle and therefore of the circuit in which the fluid to be heated is flowing brings about an increase in the pressure drops which therefore have to be minimized. It is further necessary to ensure that the heat conveyed by the combustion gases is used in a complete and efficient manner, compelling the gases to release all the heat thereof, including the latent condensation heat, to the tube bundle before being discharged to the gas exhaust. It is further necessary to minimize the spatial requirements of the heat exchanger, particularly in the case of heat exchangers with high power which may have dimensions and weights which are substantial.

The known heat exchangers are not very suitable for use at high power because the requirements set out above constitute an insurmountable obstacle or can be achieved only to the detriment of the thermal efficiency or with high production costs and running costs.

STATEMENT OF INVENTION

An object of the present invention is to overcome the disadvantages of the known exchangers in order to achieve the objectives indicated above. In particular, an object of the invention is to provide a heat exchanger of the type with a tube bundle which is wound in a helical manner and which minimizes the pressure losses in the circuit of the fluid to be heated and which maximizes the heat transfer, including the latent condensation heat, from the combustion gases to the fluid to be heated. Another objective is to provide a heat exchanger which can convey high thermal powers by efficiently using the heat of the combustion gases of a burner. Another object of the invention is to construct a heat exchanger which can be expanded in a modular manner in order to convey different thermal powers. Another object of the invention is to construct a heat exchanger, in which the combustion gases completely pass over, as uniformly as possible, the tube bundle in which the fluid to be heated flows. Another object of the invention is to provide a heat exchanger which is simple and economical to manufacture, as well as being reliable and economical to use.

According to a first aspect, there is described a heat exchanger with a tube bundle which is wound in a helical manner about a longitudinal axis. The tube bundle may comprise at least two tube sections. The at least two tube sections can be placed beside each other in the direction of the longitudinal axis. The tube sections may each comprise a helically wound tube. The tube may have an internal cross-section which is constant over the helical winding thereof. The internal cross-sections of the tubes belonging to different tube sections can be different from each other or, preferably, identical to each other. A constant internal cross-section does not exclude the presence of possible small localized deformations, such as, for example, small protuberances which are used to maintain the coils spaced apart from each other. The cross-sections and the shape of the ends of the tube sections can naturally be different from the operating cross-section along the helical winding, for example, in order to provide ad hoc connections to a collector or external pipes. The internal cross-section may preferably be constant from the point of view of the shape and dimensions, that is to say, the internal cross-section of the tube can keep the same geometry substantially over the entire extent of the helical progression thereof. From a more general point of view, the internal cross-section can remain substantially constant at least from the point of view of its area.

According to a particular aspect, the helically wound tube of each tube section may have the two ends thereof directed towards the exterior of the helix. The two ends of the tube can be directed towards the exterior of the helix in directions which are mutually parallel or angled, for example, oblique or inclined relative to each other. Each end of the tube can be directed towards the exterior of the helix in a parallel or angled direction, for example, obliquely, with respect to a radial direction. The radial direction is defined by a half line laying on a plane which is orthogonal to the longitudinal axis of the tube bundle and with the origin on said longitudinal axis. The two ends of the tube can, for example, be bent towards the exterior of the helix.

There may be provided a completion insert which can close the space between two facing ends of two respective tubes of the two tube sections which are beside each other. The arrangement of the tube sections beside each other allows the construction of a heat exchanger with great power, with minimal pressure losses over the course of the fluid to be heated. The arrangement of the tube sections beside each other allows the construction of modular heat exchangers with different powers, by selecting the number and the type of the tube sections to be placed together. The arrangement of the completion insert in the space between the outlet of a tube section and the inlet of the successive section placed beside it prevents or substantially reduces the passage of combustion gases through the section which would be a preferential outlet with a greater extent than the channels between adjacent coils, all being to the advantage of the efficiency of the heat exchanger.

According to a particular aspect, the completion insert may comprise a core made of refractory material, preferably a ceramic material. The completion insert therefore also acts as a thermal plug, preventing an excessively intense localized transmission of heat to the tubes with which it is in contact. The completion insert acts substantially as a solid body which under working conditions is maintained at a stable and suitable temperature which is determined by the mutual exchange with thermal equilibrium between the gases, the completion insert and the tube section in which the fluid flows.

According to another particular aspect, the completion insert may comprise positioning and engaging members on the tubes of the adjacent tube sections. The positioning and engaging members can allow the completion insert to automatically adapt to the geometry of the surrounding zone. In this manner, the completion insert remains securely in position during the production of the heat exchanger and the use thereof, including following slight movements between the coils of the tube sections. In a preferred variant, the positioning and engaging members can be constructed from a shaped metal sheet which can be fixed to the core made of refractory material.

According to another particular aspect, the completion insert comprises an external wall and an internal wall which can be substantially aligned with the extrados and the intrados of the coils of the adjacent tube sections, respectively.

According to another aspect, there is described that at least two tube sections of the heat exchanger may comprise a tube which is helically wound about a longitudinal axis in order to form coils with a predetermined diameter. The tube may have a flattened cross-section which is rounded at the two short sides thereof which are located at the intrados and extrados of the coils, respectively. The longest sides of the section of the tubes can be flattened and the sides of adjacent coils can face each other with a predetermined spacing. Such a configuration of the tube is simple to construct and convenient for constructing the tube sections of the heat exchanger described. Neither the coils, nor the tubes which compose them are deformed in the longitudinal direction, thereby contributing to producing a fluid circuit without constrictions, which reduces the pressure losses in the circuit. The coils are further uniformly spaced apart from each other over the entire tube bundle contributing to the uniform transmission of heat to the fluid by the combustion gases, without any heat concentrations or dead zones which are colder.

According to another aspect, the adjacent coils of the tubes which form the helical tube bundle can be maintained with a predetermined spacing from each other by means of spacer combs which are angularly distributed in a regular manner about the tube bundle. The spacer combs allow the coils of the tube bundle to be compacted, for example, by compressing the tube bundle by means of tie rods and end flanges and/or by means of the casing of the exchanger, maintaining channels with a predetermined dimension for the passage of the combustion gases through the tube bundle. When tie rods are provided, the compression conveyed by the tie rods can have a structural function in the final assembly of the exchanger.

According to another aspect, there is described a distributor for the fluid to be heated. The distributor can define distribution chambers for the fluid being introduced into and being discharged from the heat exchanger and being introduced into and being discharged from the tube sections. The distributor can be customized in accordance with the specific configuration of the heat exchanger, making it simple and economical to construct heat exchangers with different powers simply by combining tube sections at different numbers or in a different formation. For example, according to a particular aspect, the heat exchanger may comprise an even number of tube sections which can be configured to be travelled in pairs in parallel by the fluid to be heated. The corresponding pairs of discharge and introduction ends of the tubes of the tube sections can open into common distribution chambers two by two. Such a configuration is particularly efficient and allows the production of effective heat exchangers with great power. In more general terms, the heat exchanger can in any case comprise an even or odd number of tube sections which can be configured to be travelled through by the fluid to be heated individually and/or in pairs in series and/or in parallel, preferably leading into common distribution chambers which are combined in various manners, for example, common on a one to two basis, on a two to two basis or one to three basis. The possibility of differently and freely combining the introduction and discharge of the various tube sections by conforming the distribution chambers in a suitable manner allows the acquisition of a wide variety of possible configurations of the exchanger so as to cover a wide range of uses.

BRIEF DESCRIPTION OF THE DRAWINGS

Additional features and advantages will be appreciated from the following detailed description of a preferred embodiment with reference to the appended drawings, which are given by way of non-limiting example and in which.

DETAILED DESCRIPTION

Figure 1:
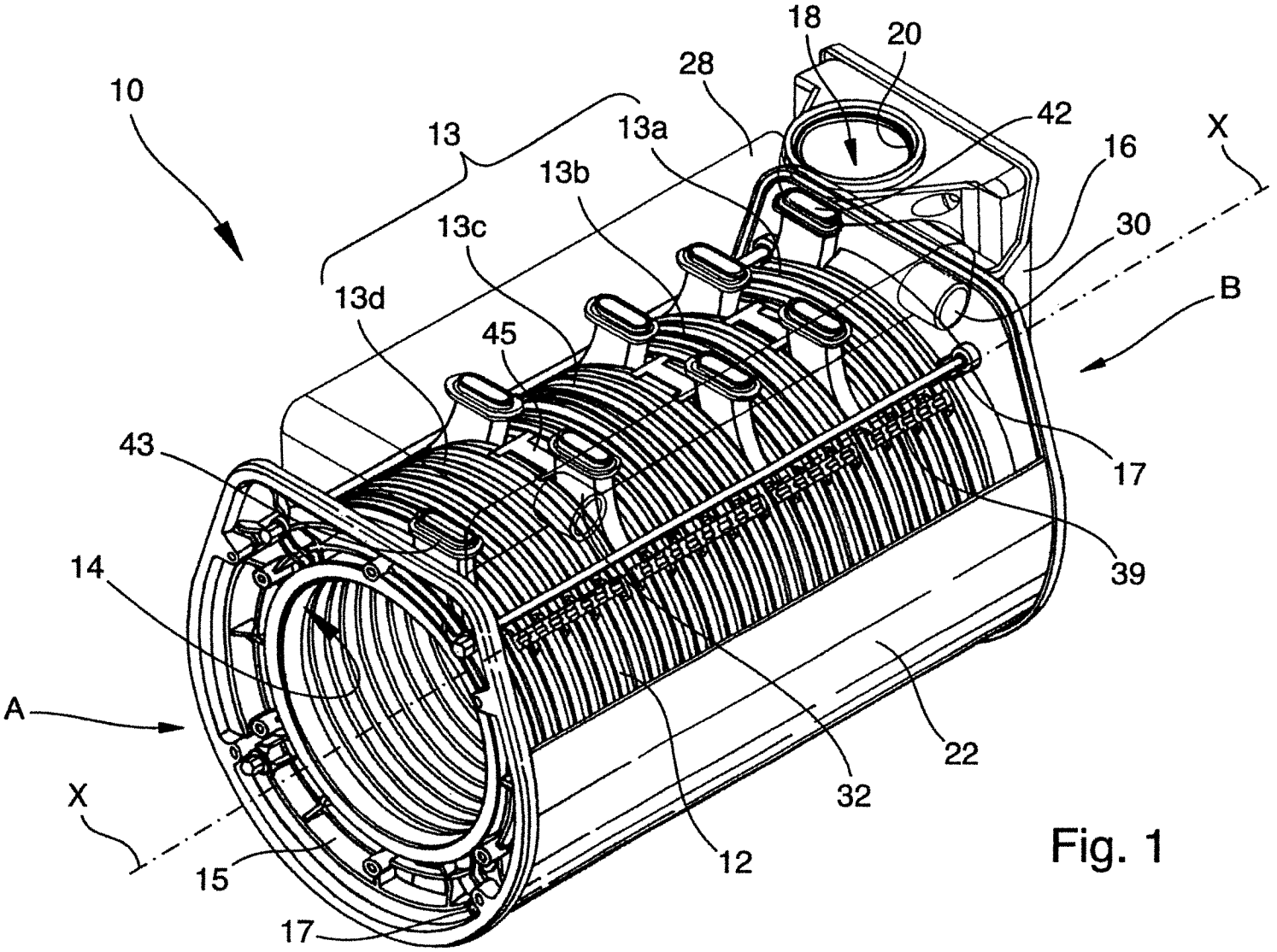
FIG. 1 is a perspective view, partially in a transparent manner for clarity of illustration, of a heat exchanger incorporating characteristics of the present invention.
Figure 2:
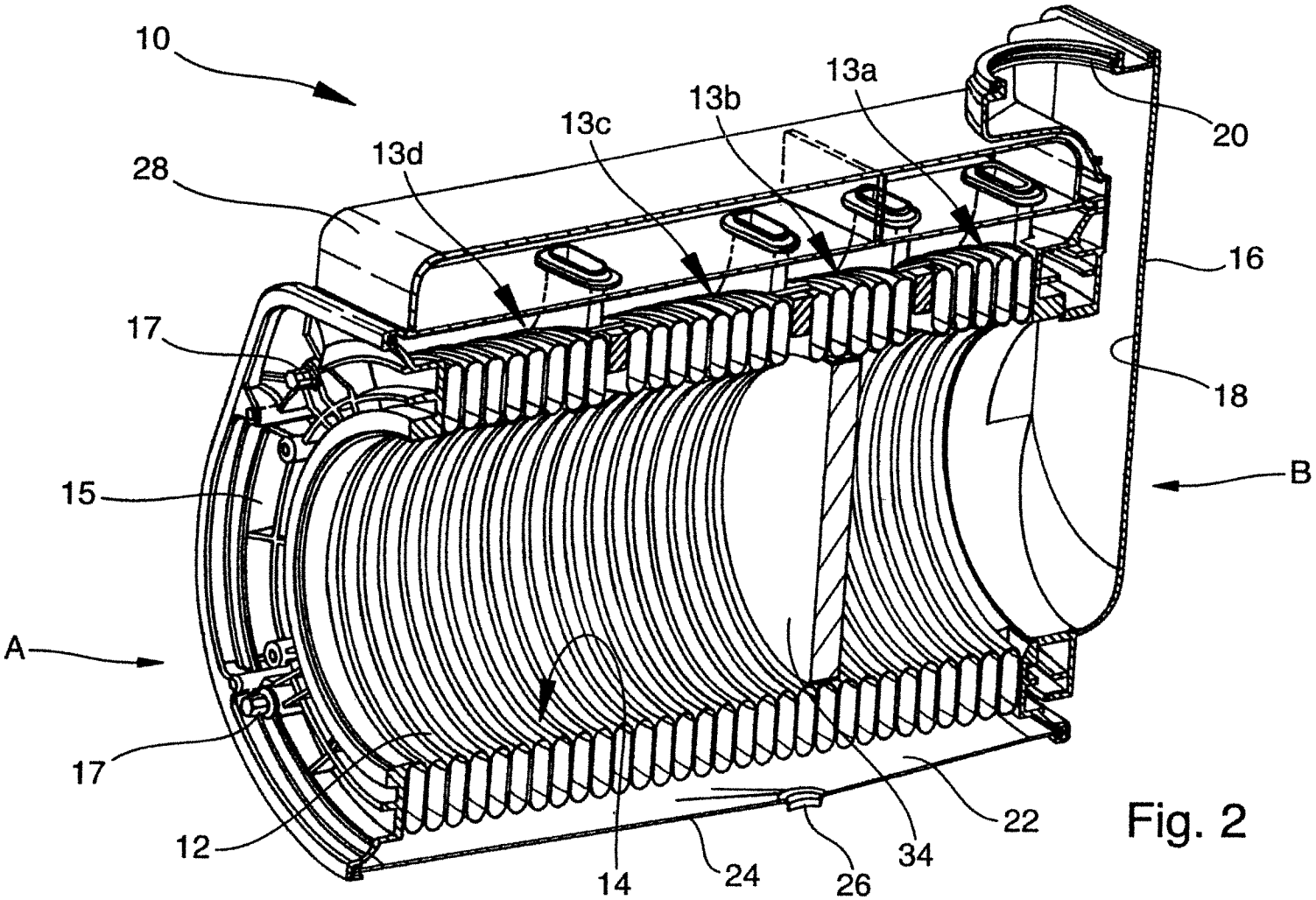
FIG. 2 is a cross-section along a longitudinal plane of the heat exchanger of FIG. 1.

With reference now to FIGS. 1 and 2 there is illustrated an example of a heat exchanger 10 incorporating characteristics of the present invention. The heat exchanger 10 comprises a tube bundle 12 which generally develops in a helical manner about a longitudinal axis X-X. The tube bundle 12 is composed of various tube sections 13, which are individually indicated with the reference numerals 13*a*, 13*b*, 13*c*, 13*d* and which are located beside each other along the longitudinal axis X-X.

The tube bundle 12 defines a substantially cylindrical chamber 14 which during use is occupied by the combustion gases of a burner (not illustrated) which, as known, is mounted at a side A of the heat exchanger, in particular on an annular head structure 15. The other side of the heat exchanger 10, which is indicated by the arrow B, is closed by a cover 16 which defines a chamber 18 with a discharge opening 20 for the combustion gases. The head structure 15 and the cover 16 are fixed directly to each other by means of long tie rods 17 which run externally with respect to the tube bundle 12. In the example illustrated in the Figures, there are four tie rods 17 which are distributed with regular spacing angularly at 90° about the tube bundle 12, even if naturally it is possible to provide a different number of tie rods 17 from the number illustrated. The tie rods 17 are preferably constructed by means of metal bars and are fixed to the head structure 15 and the cover 16, preferably by means of nuts which are screwed to threaded ends of the metal bars. Preferably, there are provided on the seats of the nuts sealants, for example, seals or O-rings, in order to ensure the tightness with respect to the combustion gases which could otherwise tend to be discharged through the openings in the head structure 15 and/or the cover 16 through which the ends of the tie rods 17 extend.

The tube bundle 12 is externally surrounded by a covering shell 22 which is substantially cylindrical and which retains the combustion gases inside the heat exchanger 10. The covering shell 22 encloses and also protects the tie rods 17. The arrangement of the tie rods 17 inside the covering shell 22 further reduces the overall spatial requirement of the heat exchanger 10 with respect to the solutions which provide for tie rods outside the covering shell. For reasons of clarity, FIG. 1 illustrates only a portion of the covering shell 22. In the lower portion, the wall 234 of the covering shell 22 is slightly inclined towards a condensate discharge 26 (see FIG. 2).

Figure 3:
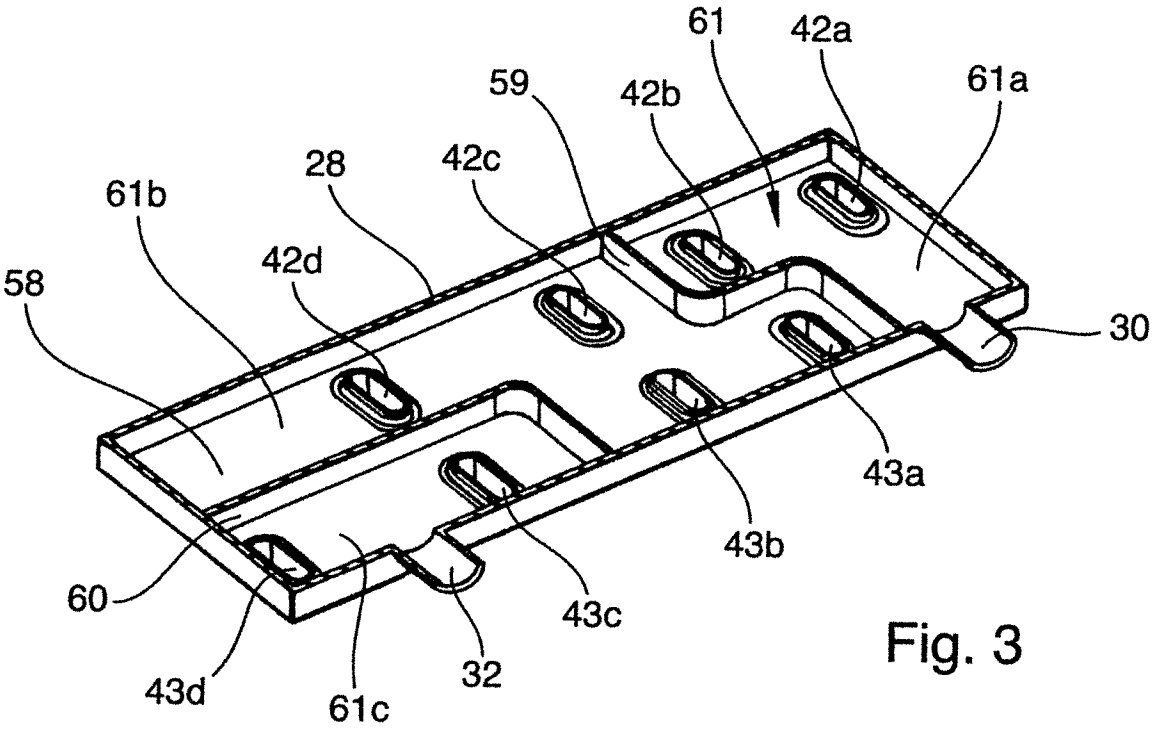
FIG. 3 is a perspective view of the internal configuration of the distributor of the fluid which flows through the coils of the tube bundle of the heat exchanger of FIG. 1.

In the upper portion of the heat exchanger 10, preferably in a state integrated in the covering shell 22, there is mounted a distributor 28, the interior of which is illustrated in detail in FIG. 3. The distributor 28 has an inlet 30 for the fluid to be heated in the heat exchanger 10 and an outlet 32 for the fluid which is heated by flowing through the coils of the tube bundle 12 which is passed over by the combustion gases. In the cylindrical chamber 14 which is formed by the tube bundle 12, there is mounted a separation wall 34 (FIG. 2) which interrupts the flow of the combustion gases along the axis X-X, forcing them through the tube bundle 12 in a radial direction, through the space between one coil and the next, in order to increase the thermal exchange and the transfer of heat to the fluid which flows through the tube bundle 12. The combustion gases are conveyed into the annular gap between the tube bundle 12 and the covering shell 22 in order to re-enter the cylindrical chamber 14 downstream of the separation wall 34 and to be finally conveyed into the chamber 18 of the cover 16 and to be finally discharged from the heat exchanger through the gas exhaust 20 after having also transferred to the fluid which flows through the tube bundle 12 the latent condensation heat of the water vapour which is contained in the combustion gases. As mentioned above, the condensate is collected on the bottom of the covering shell 22 and is discharged from the condensate exhaust 26.

Each tube section 13 is formed by a tube 36 which is helically wound so as to form a specific number of coils 38 with a predetermined diameter. The tube 36 preferably has a flattened section, which is rounded at the two short sides 36*a* thereof which are located at the intrados I and the extrados E of the coils 38, respectively. The longer, flattened sides 36*b* of the tubes 36 of adjacent coils face each other. The adjacent coils 38 are maintained with a predetermined spacing from each other by teeth 37 of spacer combs 39 being inserted between one coil and another. The spacer combs 39 are distributed angularly in a regular manner about the tube bundle 12 (see FIGS. 1 and 6). Given the formation of the tube bundle, the head 15 and the cover 16 have suitable seats for receiving additional teeth which allow the application of identical spacer combs 39 in the tube sections 13 of the same size.

The tube 36 of each tube section 13 has two ends 40, 41, from which the fluid which is intended to be heated by the combustion gases which pass over the tube bundle 12 of the heat exchanger 10 is introduced and discharged, respectively. An inlet opening 42 is formed at the end 40 of the tube 36. An outlet opening 43 is formed at the end 41 of the tube 36. The ends 40, 41 of the tube 36 are curved towards the exterior of the circumference which is formed by the coils 38 and are both formed in such a manner that the inlet opening 42 and outlet opening 43 have the axes thereof parallel with each other and parallel with a radius R of the coils 38. The inlet opening 42 and outlet opening 43 are arranged symmetrically at opposite sides of and with identical spacing from a longitudinal plane, passing through the radius R and the longitudinal axis X-X of the tube section 13, which is coincident with the longitudinal axis X-X of the heat exchanger 10.

Figure 6:
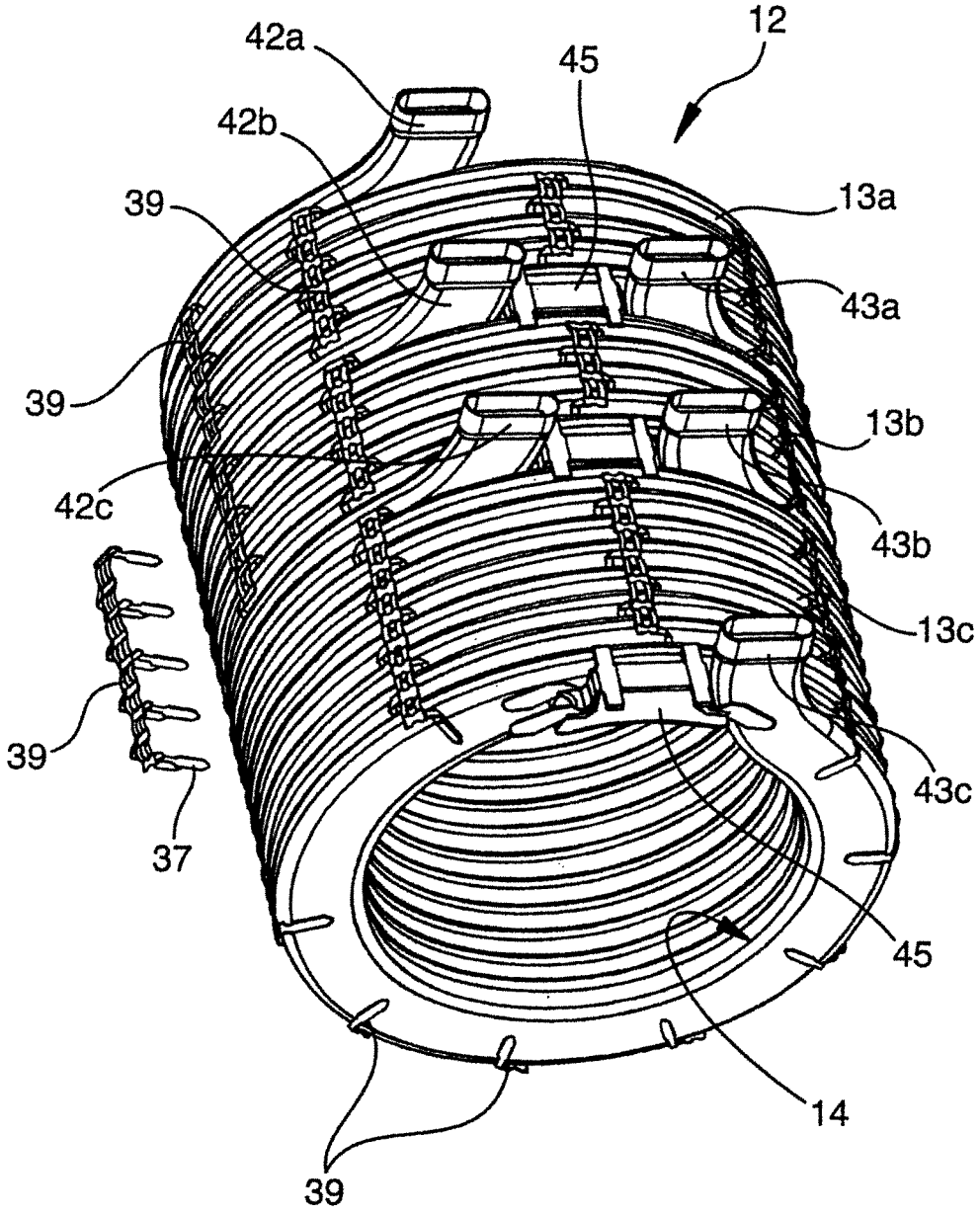
FIG. 6 is a perspective view of part of the assembly of the coils which form the tube bundle of the heat exchanger of FIG. 1.

The configuration of the tube section 13 described above is such that two adjacent tube sections 13, for example, the tube sections 13*a* and 13*b*, or the tube sections 13*b* and 13*c* which are illustrated in FIG. 6, can be placed beside each other so as to substantially constitute a tube bundle, the adjacent coils of which are all uniformly spaced apart from each other, including at locations where the last coil of a tube section, for example, 13*a* or 13*b*, is beside the first coil of the adjacent tube section, for example, 13*b* or 13*c*, respectively (see FIG. 6). All the inlet openings 42 of the tube sections 13 are aligned in a longitudinal direction parallel with the axis X-X. All the outlet openings 43 of the tube sections 13 are also aligned in a longitudinal direction parallel with the axis X-X.

A completion insert 45 is interposed between two tube sections 13 which are beside each other. The completion insert 45 is interposed between the coils of the two adjacent tube sections 13, in particular in the space between the outlet opening 43 of a tube section 13, for example, the tube section 13*a* or 13*b*, and the inlet opening 42 of an adjacent tube section 13, for example, the tube section 13*b* or 13*c* of FIG. 6, respectively. In this manner, the completion insert 45 closes this space which would otherwise be more extensive than the spacing between the coils of the tube bundle and would therefore constitute a preferential passage for the combustion gases. As a result of the completion insert 45, the above-mentioned space is closed or in any case reduced in such a manner that it does not allow combustion gases to escape into a zone, where it would pass only marginally over the tube bundle, with a loss of efficiency in the transmission of the heat to the fluid which flows through the tube bundle. The completion insert 45 substantially acts as a thermal plug.

Figure 5:
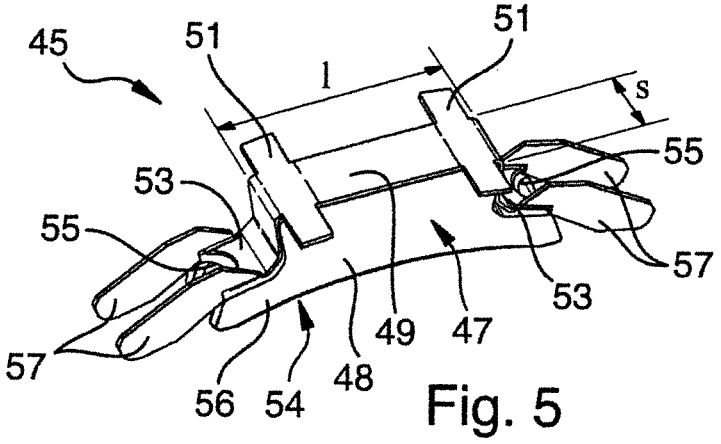
FIG. 5 is a perspective view, drawn to an enlarged scale, of a completion insert which is interposed between two adjacent tube sections of the tube bundle of the exchanger of FIG. 1.
Figure 4:
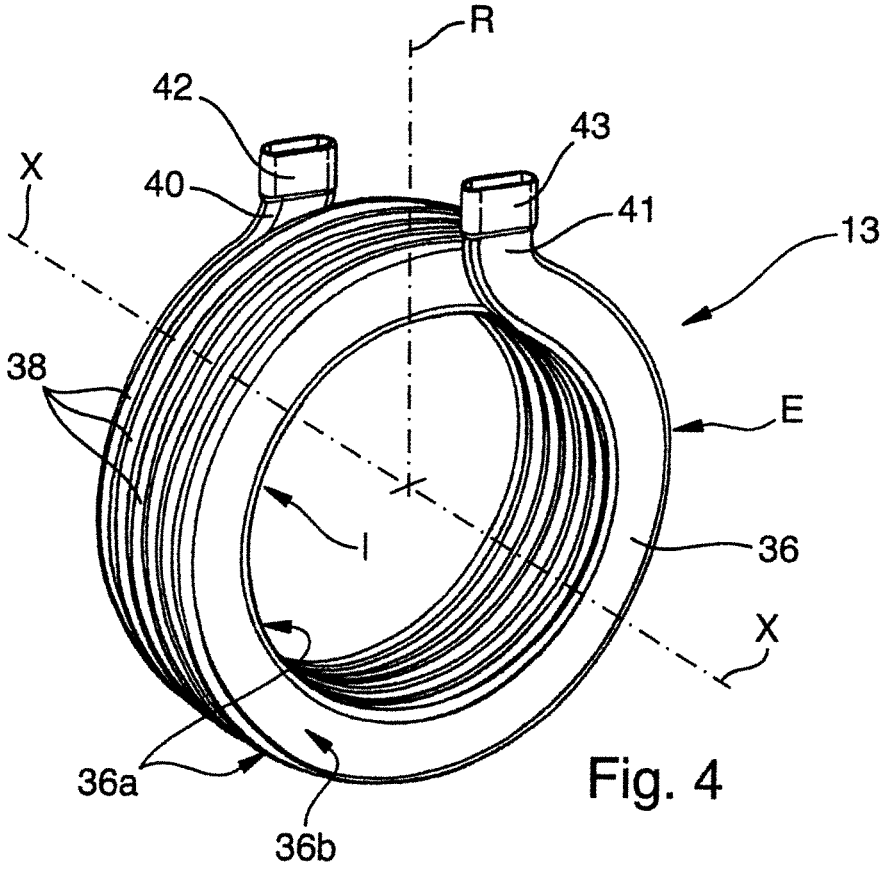
FIG. 4 is a perspective view of a tube section of the tube bundle of the heat exchanger of FIG. 1.

FIG. 5 illustrates in greater detail and to a greater scale the completion insert 45 which comprises a main body 47 which has a thickness s which is substantially equal to or slightly less than the pitch of the coils of the tube bundle 12, in the case of a constant pitch over the entire extent of the heat exchanger. If the tube bundle 12 comprises tube sections 13 with different pitches between the relevant coils, the thickness of the completion insert 45 is consequently adapted so as to substantially correspond to or be slightly less than the space between the coils of two adjacent tube sections 13, in the zone between the outlet opening 43 of a tube section 13 and the inlet opening 42 of the tube section 13 adjacent thereto. In particular, the lateral faces 48 of the main body 47 preferably define a contact zone of heat exchange with the adjacent coils of the tube bundle 12. The main body 47 comprises an external wall 49 which in the configuration shown of the completion insert 45 faces the exterior of the tube bundle 12, substantially in alignment with the extrados of the coils. The external wall 49 has a length l which is slightly less than the spacing between the ends 40, 41 of the tubes 36 which form the outlet opening 43 and inlet opening 42 of the adjacent tube sections 13. There is formed on the external wall 49 a pair of wings 51 which project from both sides of the external wall 49 and which are intended to be supported on the extrados of the coils of the adjacent tube sections 13. In the most internal portion 53, corresponding to the intrados of the coils of the tube sections 13, the main body 47 extends beyond the extent l of the external wall 49 and comprises an internal wall 54 which takes up a curved configuration which substantially imitates the curvature at the intrados of the coils of the tube bundle 12 and is concentric relative thereto and spaced apart, for example, by a few centimetres, in order to protect it during any cleaning operations for maintenance.

At the lateral ends 56 of the main body 47, in extension of the internal portion 53 thereof, there are formed respective loops 55 which imitate the curvature of the short sides 36*a* of the tubes 36 in the region of the ends 40, 41 thereof which form the outlet opening 43 and inlet opening 42 of the adjacent tube sections 13. Two pairs of walls 57 which are supported against the long sides 36*b* of the tubes 36 extend from the lateral ends 56 of the main body 47, including in this case in the region of the ends 40, 41 thereof which form the outlet opening 43 and inlet opening 42 of the adjacent tube sections 13.

In a preferred embodiment, the main body of the completion insert 45 comprises a core made of ceramic material or more generally refractory material. Preferably, the refractory material of the fibrous type is compressed, adapting to the rectilinear surfaces of the long contact sides 36*b* of the tube section 36 so as to ensure effective sealing. Advantageously, a single shaped and bent metal sheet is fixed to the refractory core of the main body in order to define the external wall 49 and the wings 51 in addition to the lateral ends 56 with the loops 55 and the walls 57.

All the inlet openings 42 and outlet openings 43 of the tube sections 13 extend as far as a common plane orthogonal relative to the radius direction R so as to open in all cases inside the distributor 28, as illustrated in FIG. 3, in which the distributor 28 is illustrated in an uncovered state so as to make the internal distribution clearly visible. In particular, the distributor 28 comprises a base plate 58 in which there are formed shaped openings, to which the edges of the inlet openings 42*a*, 42*b*, 42*c*, 42*d* and the outlet openings 43*a*, 43*b*, 43*c*, 43*d* which are located at the two ends of the tube sections 13*a*, 13*b*, 13*c*, 13*d*, respectively, are welded.

The interior of the distributor 28 is divided by means of dividing walls 59, 60 which form communication chambers 61 between the various tube sections 13 of the heat exchanger 10 in order to define the path of the fluid from the inlet 30 to the outlet 32. In particular, as illustrated in the example of FIG. 3, the inlet 30 of the fluid to be heated communicates with a first communication chamber 61*a* in which the inlet openings 42*a*, 42*b* of the tube sections 13*a*, 13*b* open. The cold fluid which is introduced into the heat exchanger through the inlet 30 is therefore directed parallel in the two tube sections 13*a*, 13*b* and is introduced from the inlet openings 42*a*, 42*b*. After passing through the coils of the tube sections 13*a*, 31*b*, the fluid is discharged at a higher temperature from the outlet openings 43*a*, 43*b* which lead into a second communication chamber 61*b* of the distributor 28. The inlet openings 42*c*, 42*d* of the tube sections 13*c*, 13*d* also open in the second communication chamber 61*b*. The fluid being discharged from the tube sections 13*a*, 13*b* is therefore directed in parallel in the two tube sections 13*c*, 13*d* and is introduced from the inlet openings 42*c*, 42*d*. After passing through the coils of the tube sections 13*c*, 13*d*, the fluid is discharged at an even higher temperature from the outlet openings 43*c*, 43*d* which open in a third communication chamber 61*c* of the distributor 28. The third communication chamber 61*c* also communicates with the outlet 32 of the fluid heated by the heat exchanger 10 for transmission to the users, for example, a water heating installation of known type.

The heat exchanger 10 is constructed by placing different tube sections 13 beside each other so that the respective inlet openings 42 and outlet openings 43 have the axes thereof all parallel with each other and also all parallel with the same longitudinal plane, passing through the axis X-X which divides into two portions the space between the inlet and outlet openings of adjacent tube sections 13. In other words, as also explained above, the inlet openings 42 and outlet openings 43 of adjacent tube sections are arranged symmetrically at opposite sides and with identical spacing from the above-mentioned longitudinal plane.

Respective completion inserts 45 are interposed between the adjacent tube sections 13 in order to close the space between the outlet opening 43 of a tube section 13 and the inlet opening 42 of the adjacent tube section 13. Each completion insert 45 is positioned in such a manner that the wings 51 are supported on the extrados E of the coils 38 of the two adjacent tube sections 13 and in particular are supported on the short side 36*a* of the tubes 36 on the extrados E of the coils 38 of the adjacent tube sections 13. The walls 57 of the completion insert 45 are located beside the ends 40, 41 of the tubes 36 of the two tube sections 13 in the region of the long sides 36*b* of the respective tubes 36. The loops 55 are placed beside and preferably in contact with the short sides 36*a* of the ends 40, 41 of the tube sections 13 while the sides of the main body 47 are positioned beside the long sides 36*b* of the tubes 36 so as to close virtually completely, or in any case to considerably reduce, the space between the ends 40, 41 of the tubes 36 of the two tube sections 13 so as to prevent or in any case to considerably inhibit the passage of the combustion gases in this zone.

The distributor 28 is mounted in such a manner that the inlet openings 42 and outlet openings 43 which are welded to the respective shaped openings which are formed in the base plate 58 of the distributor 28 lead therein. The heat exchanger 10 is completed by mounting thereon the separation wall 34 and the combs 39 and covering the whole with the covering shell 22. At the ends of the covering shell 22, there are mounted the cover 16 and the annular head structure 15 which are clamped to each other by the tie rods 17 which run externally relative to the tube bundle 12.

During use of the heat exchanger 10, there is mounted on the head structure 15 a burner of the known type, the combustion gases of which pass over the tubes 36 of the tube sections 13 which form the tube bundle 12. The combustion gases transmit the heat thereof, including the latent condensation heat, to the fluid which flows inside the tube bundle 12 which is heated by being introduced from the fluid inlet 30 as far as the outlet 32 which is connected to the users in a known manner.

The composition of the heat exchanger 10 by means of the tube sections 13 allows the production of powers which cannot be obtained with a conventional heat exchanger with a single tube bundle. Furthermore, the arrangement of the tube sections 13 allows the power of the heat exchanger to be varied by varying the type, the configuration and the number of the tube sections 13, which, for example, may be greater or less in number than that of the embodiment described above in detail. The tube sections 13 may differ from each other as a result of the number of coils, diameter and form of the section of the tube, diameter of the helical winding of the tube. The arrangement of the completion inserts 45 allows the production of the tube sections 13 with uniform coils without it being necessary to deform or bend the tube 36 in any manner in the longitudinal direction (X-X). The forming of the tube sections 13 can therefore be carried out at a high speed and great economy using tube-bending machines which are commonly known in the sector without it being necessary to provide forming stamps or intervening in the tube sections in any manner.

The tubes 36 which form the tube sections therefore have a cross-section, in particular the internal cross-section, which is constant and non-deformed over the entire extent thereof, which contributes to reducing the pressure losses over the path of the fluid to be heated. The distribution in parallel of the fluid over two or more tube sections, though not being necessary, is preferable because it contributes to reducing the pressure losses in the fluid circuit by increasing the fluid flow rate and therefore the power of the heat exchanger.

Figure 7:
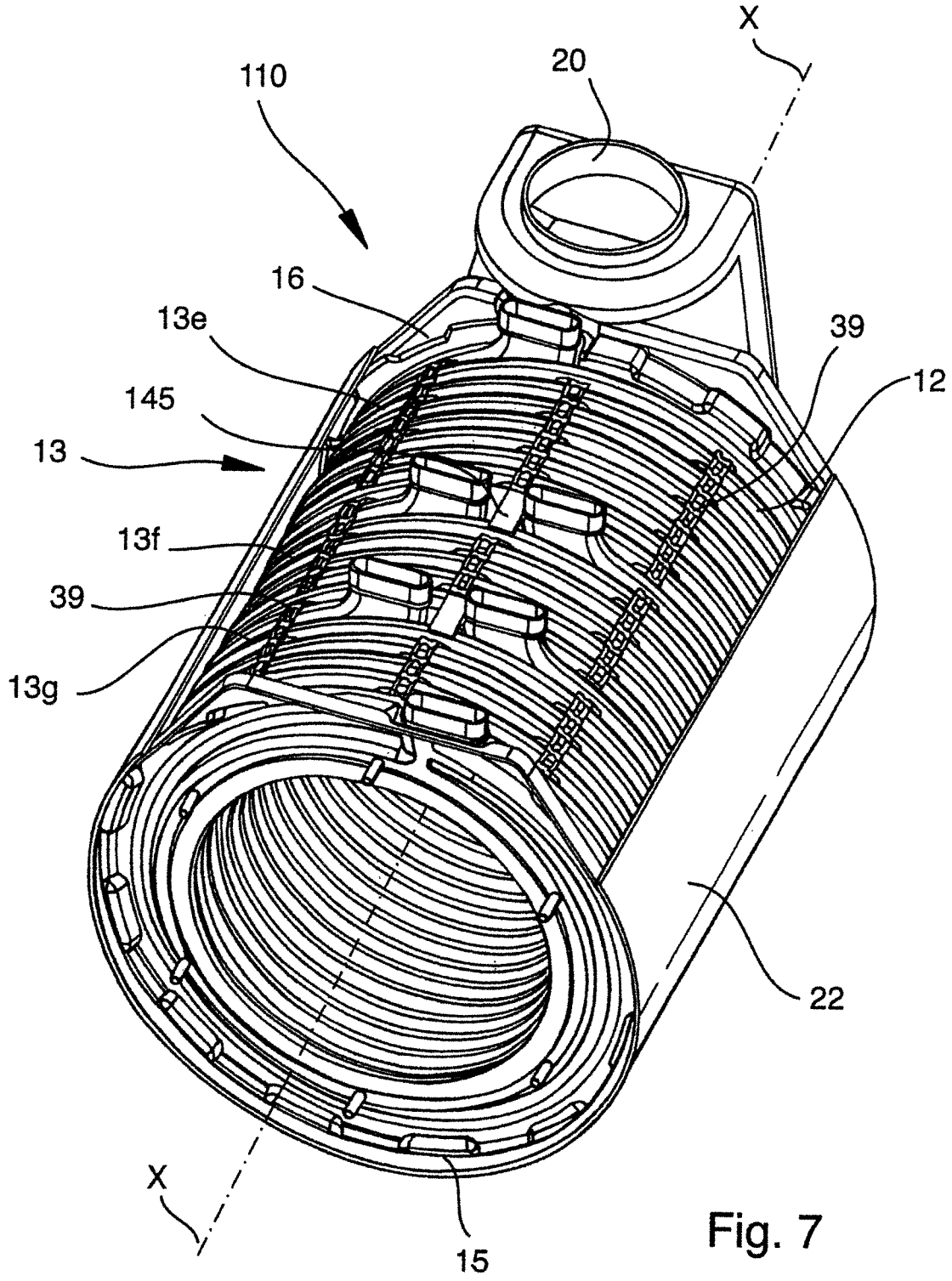
FIG. 7 is a perspective view of another embodiment of a heat exchanger incorporating characteristics of the present invention without the fluid distributor and partially without the casing for the sake of greater clarity of illustration.

With reference now to FIG. 7, there is illustrated another embodiment of a heat exchanger 110 incorporating features of the present invention. Identical reference numerals identify identical or functionally identical elements with respect to those described above with reference to the embodiment of FIG. 1. Unless expressly indicated otherwise, or inferable indirectly from the context of the description, the heat exchanger 110 may have completely or partially the structural arrangements and the detailed specifications described above with reference to the embodiment of FIG. 1.

The heat exchanger 110 comprises the tube bundle 12 which generally develops helically about a longitudinal axis X-X. The tube bundle 12 is composed of the various tube sections 13 which are individually indicated with the reference numerals 13*e*, 13*f*, 13*g* and which are located beside each other along the longitudinal axis X-X.

The tube bundle 12 defines the substantially cylindrical chamber 14 which is during use occupied by the combustion gases which are discharged from the discharge opening 20. Unlike the embodiment of the above-described FIG. 1, the heat exchanger 110 does not comprise tie rods but instead the compression of the coils of the tube bundle 12 on the teeth of the spacer combs 39 is brought about by the covering shell 22 which is fixedly joined at the two ends thereof at one side to the head structure 16 and at the other side to the cover 16. For reasons of clarity, FIG. 7 also illustrates only a portion of the covering shell 22 which can be formed so as to be inclined in the lower portion thereof towards a condensate discharge.

The formation of the tube bundle 12 and in particular the tube sections 13 is similar to what has been described above with reference to the embodiment of FIG. 1. In particular, each tube section 13 is formed by a tube which is wound in a helical manner and which preferably has a flattened cross-section and the adjacent coils of which are maintained with a predetermined spacing of the spacer combs 39, which are preferably distributed angularly and regularly about the tube bundle 12. The tube of each tube section 13 has two ends, from which the fluid which is intended to be heated by the combustion gases is introduced and discharged.

Figure 8:
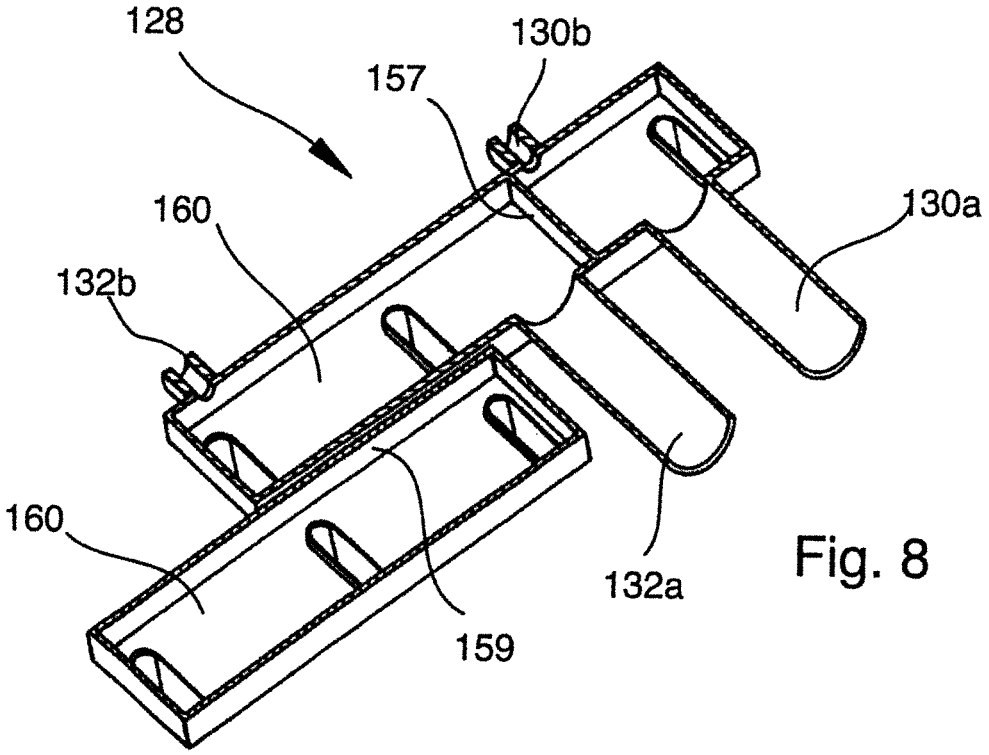
FIG. 8 is a perspective view of the internal configuration of the distributor of the fluid which flows through the coils of the tube bundle of the heat exchanger of FIG. 7.

There is mounted on the upper portion of the heat exchanger 10 a distributor 128, the interior of which is illustrated in detail in FIG. 8. The distributor 128 has two inlets 130*a*, 130*b* for the fluid to be heated in the heat exchanger 110 and two outlets 132*a*, 132*b* for the fluid which is heated by flowing through the coils of the tube bundle 12 which is passed over by the combustion gases. The interior of the distributor 128 is divided by means of dividing walls 157 or walls 159 which form communication chambers 160 between the various tube sections 13 of the heat exchanger 10 in order to define the path of the fluid from the inlets 130*a*, 130*b* to the outlets 132*a*, 132*b*. The ends of the tubes of the tube sections 13 which are placed in communication with each other lead into the communication chambers 160, thereby defining the path of fluid to be heated inside the coils of the tube bundle 12.

Figure 9:
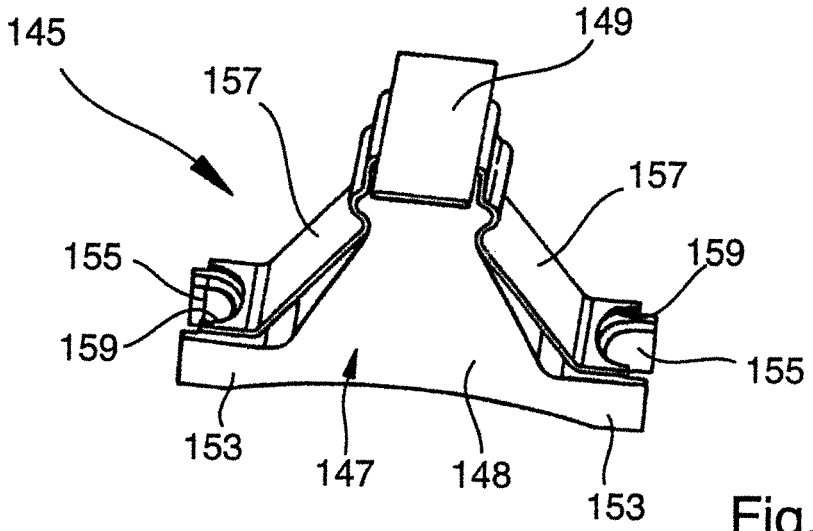
FIG. 9 is a perspective view, drawn to an enlarged scale, of a completion insert which is interposed between two adjacent tube sections of the tube bundle of the exchanger of FIG. 7.

FIG. 9 illustrates an alternative embodiment of a completion insert 145 which is interposed between two tube sections 13 which are beside each other. The completion insert 145 can be interchanged with the insert 45 which is described above with reference to the embodiment of the heat exchanger of FIG. 1. The completion insert 145 comprises a main body 147 which has a thickness which is substantially identical or slightly less than the pitch of the coils of the tube bundle 12, in the case of a constant pitch over the entire extent of the heat exchanger. In particular, the lateral faces 148 of the main body 147 preferably define a contact zone of heat exchange with the adjacent coils of the tube bundle 12. The main body 147 comprises an external wall 149 which in the configuration shown of the completion insert 145 faces the exterior of the tube bundle 12 and projects with respect to the thickness of the main body 147 so as to be supported on the extrados of the coils of the adjacent tube sections 13. In the innermost portion, corresponding to the intrados of the coils of the tube sections 13, the main body 147 has two extension pieces 153, on which there are formed respective loops 155 which imitate the curvature of the short sides of the tubes in the region of the ends thereof which form the outlet and inlet openings of the adjacent tube sections 13. A pair of resilient sheets 157 with respective loops 159 is intended to fix the completion insert 145 in position. In this case, the main body of the completion insert 145 also preferably comprises a core made of ceramic material or more generally refractory material.

Figure 10:
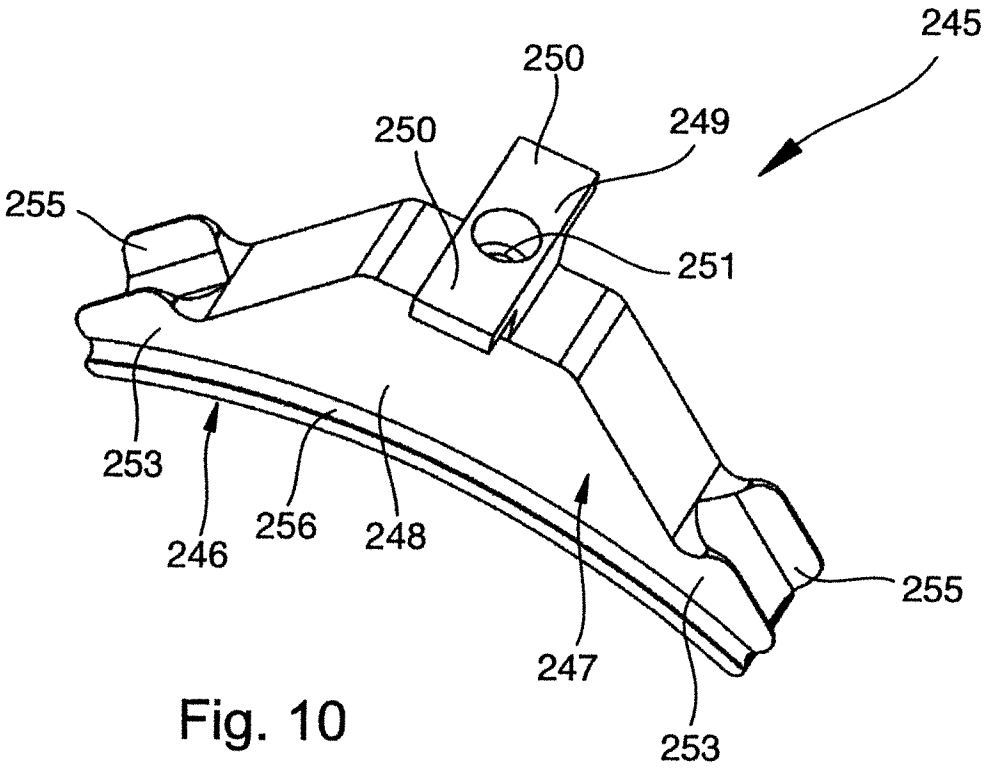
FIG. 10 is a perspective view, drawn to an enlarged scale, of a variant of the completion insert of FIG. 9.

FIG. 10 illustrates a variant of the completion insert which is interposed between two tube sections which are beside each other. The completion insert 245 can be interchanged with the insert 45 and the insert 145 described above with reference to the embodiment of the heat exchangers of FIG. 1 and FIG. 7, respectively. The completion insert 245 comprises a main body 247 which has a thickness substantially identical to or slightly less than the pitch of the coils of the tube bundle 12, in the case of a constant pitch over the entire extent of the heat exchanger. In particular, the lateral faces 248 of the main body 247 preferably define a contact zone of heat exchange with the adjacent coils of the tube bundle 12. There is mounted on the main body 247 a support block 249 which is substantially T-shaped with two wings 250 which in the mounted configuration of the completion insert 245 are facing the exterior of the tube bundle 12 and which project with respect to the thickness of the main body 247 so as to be supported on the extrados of the coils of the adjacent tube sections 13. The support block 249 is fixed to the main body 247 with a screw 251 which allows the completion insert to be clamped on the tube bundle 12.

In the innermost portion, corresponding to the intrados of the coils of the tube sections 13, the main body 147 extends so as to form two extension pieces 253 on which respective loops 255 which imitate the curvature of the short sides of the tubes in the region of the ends thereof which form the outlet and inlet openings of the adjacent tube sections 13 are formed. There are formed on the two lateral faces 248, behind the lower arcuate face 246 of the completion insert 245, two respective curved channels 256 in which a sealant which is suitable for withstanding the high temperatures is positioned. Similar channels for "high-temperature" sealant can also be provided in the embodiments of the completion insert 45 and 145 described above.

As described for the preceding embodiment of FIG. 1, the heat exchanger 110 is also constructed by placing different tube sections 13 one on the other in such a manner that the respective inlet and outlet openings have the axes thereof all parallel with each other and also all parallel with the same longitudinal plane, passing through the axis X-X, which divides into two portions the space between the inlet and outlet openings of adjacent tube sections 13. In other words, as also explained above, the inlet and outlet openings of adjacent tube sections are arranged symmetrically at opposite sides and with identical spacing from the above-mentioned longitudinal plane.

In the embodiments which are described above in detail and which are illustrated in the Figures, reference is made to a tube with a flattened cross-section and rounded short sides, but naturally it is also possible to carry out the invention by using a tube with a different cross-section, for example, a circular, oval, elliptical cross-section or another shape which is advantageous and generally used in the exchangers of the type. In this regard, a person skilled in the art who is reading the present description and who is learning about the innovative concepts thereof will know how to adapt the members of the heat exchanger, including the completion inserts, to forms of the tube bundle and to tube sections which are different from those illustrated and described above merely by way of example.

The heat exchangers described and illustrated by way of example provide for a tube bundle which extends in a helical manner with a single diameter of the intrados. Naturally, it is possible to construct a heat exchanger which incorporates the principles of the present invention, wherein the tube bundle has one or more tube sections with different diameters of the intrados. A particular form of the tube bundle may provide for two or more tube sections with different diameters which are arranged concentrically one inside the other. It is further possible to construct a tube bundle, in which one or more tube sections are constructed with a tube which contains therein a second tube which belongs to another tube section, for example, in order to construct two different fluid circuits in order to supply differentiated users.

In the examples described and illustrated, the tubes which are wound in a helical manner of the tube sections have the two ends thereof directed towards the exterior of the helix in mutually parallel directions and parallel with respect to a radial direction. However, it is possible to construct a heat exchanger which incorporates the principles of the present invention and in which the two ends of the tube which is wound in a helical manner are directed towards the exterior of the helix in directions which are angled relative to each other, as they can be angled with respect to a radial direction.

In the examples described and illustrated above, the openings at the ends of the tubes have been defined as "inlet openings" and "outlet openings" for the sake of ease of description and simplicity of presentation with reference to specific, non-limiting embodiments. In accordance with the configuration of the circuit of the fluid to be heated, and because of the mutual connection between the various tube sections, the fluid may flow through each tube section in one of the two directions. In this manner, the openings at the ends of each tube section perform the function of the inlet opening or outlet opening in accordance with the direction in which it is flowed through by the fluid to be heated, regardless of the position thereof in the heat exchanger. In other words, with respect to what has been described and illustrated, the openings which are conventionally indicated as "inlet" and "outlet" openings can for all the effects be transposed, that is to say, "outlet" and "inlet", respectively, in embodiments which are different but equivalent to those described and illustrated above.

Naturally, the principle of the invention remaining the same, the forms of embodiment and details of construction may be varied widely with respect to those described and illustrated, without thereby departing from the scope of the present invention.

The invention claimed is:

1. A heat exchanger with a tube bundle which is wound in a helical manner about a longitudinal axis, wherein the tube bundle comprises at least two tube sections which are placed adjacent to one another in the direction of the longitudinal axis, each tube section comprising a helically wound tube defining a helical winding about the longitudinal axis so as to form coils, the adjacency being such that the coils are uniformly spaced over the entire tube bundle, the helically wound tube of said each tube section having an internal cross-section which is constant over the helical winding of the helically wound tube, wherein the at least two tube sections which are placed adjacent to one another in the direction of the longitudinal axis each comprise a tube which is wound in a helical manner with two ends thereof directed towards an exterior of a helix in directions which are mutually parallel or angled and which are parallel or angled with respect to a radial direction, a completion insert being provided in order to close a space between facing ends, which are adjacent to one another, of two respective tubes of adjacent tube sections, the facing ends comprising an outlet end of one of the adjacent tube sections and an inlet end of the other of the adjacent tube sections.

2. The heat exchanger according to claim 1, wherein the completion insert comprises a core made of a refractory material.

3. The heat exchanger according to claim 1, wherein the completion insert comprises positioning and engaging members in order to position and engage the completion insert on the tubes of the adjacent tube sections.

4. The heat exchanger according to claim 3, wherein the positioning and engaging members are constructed from a shaped metal sheet which is fixed to the core made of refractory material.

5. The heat exchanger according to claim 1, wherein the completion insert comprises an external wall and an internal wall which are substantially aligned with an extrados and an intrados of the coils of the adjacent tube sections, respectively.

6. The heat exchanger according to claim 1, wherein each of the at least two tube sections comprise a respective tube that is helically wound about the longitudinal axis so as to form the coils having a predetermined diameter, each helically wound tube having a flattened cross-section that includes two opposite shortest sides, the two opposite shortest sides being located respectively at an intrados and an extrados of the coils, and further having two longer flattened sides, wherein the longer flattened sides of adjacent coils face each other with a predefined spacing.

7. The heat exchanger according to claim 1, wherein adjacent coils of the tubes form the helical tube bundle and are maintained with a predetermined spacing from each other by spacer combs which are angularly distributed in a regular manner about the tube bundle.

8. The heat exchanger according to claim 1, comprising a distributor with distribution chambers for the fluid being introduced into and discharged from the heat exchanger and the tube sections.

9. The heat exchanger according to claim 1, wherein the at least two tube sections comprise an even number of tube sections, each tube section having an inlet end and an outlet end, wherein the tube sections are configured to be traveled in pairs in parallel by the fluid to be heated, so that each pair of tube sections provides a corresponding pair of inlet ends and a corresponding pair of outlet ends, the inlet ends of the pair of tube sections leading into a common distribution chamber and the outlet ends of the pair of tube sections leading into another common distribution chamber two by two.

* * * * *